United States Patent [19]

Kitazawa et al.

[11] Patent Number: 4,482,351

[45] Date of Patent: Nov. 13, 1984

[54] PROCESS FOR REMOVING ASH FROM COAL

[75] Inventors: Kohji Kitazawa, Hyogo; Toshio Ozaki, Osaka, both of Japan

[73] Assignee: Hitachi Shipbuilding & Engineering Co., Ltd., Osaka, Japan

[21] Appl. No.: 459,691

[22] PCT Filed: Apr. 14, 1982

[86] PCT No.: PCT/JP82/00120

§ 371 Date: Dec. 27, 1982

§ 102(e) Date: Dec. 27, 1982

[87] PCT Pub. No.: WO83/03619

PCT Pub. Date: Oct. 27, 1983

[51] Int. Cl.[3] ..... C10L 5/00; C10L 9/00

[52] U.S. Cl. ..... 44/1 R; 44/15 R; 209/127 A

[58] Field of Search ..... 44/1 SR, 1 A, 1 R; 201/17; 423/460, 461; 209/127–129

[56] References Cited

U.S. PATENT DOCUMENTS

| | | | |
|---|---|---|---|
| Re. 21,302 | 12/1939 | Grote | 423/460 |
| 1,153,182 | 9/1915 | Schniewind | 44/1 A |
| 3,809,373 | 5/1974 | Brock | 209/129 X |
| 3,909,211 | 9/1975 | Diaz et al. | 44/1 SR |
| 4,053,285 | 10/1977 | Robinson | 44/1 SR |

*Primary Examiner*—Carl F. Dees

*Attorney, Agent, or Firm*—Joseph W. Farley

[57] ABSTRACT

A process for removing ash from coal comprising the steps of transferring pulverized coal to be treated by entraining it on a stream A of anti-oxidation gas, feeding the coal laden gas into dry-type electric precipitating chamber means 2 after suitably adjusting the temperature and humidity of the gas during transport, and separating particulate ash from the coal particles by capturing the former in the chamber means 2 by virtue of difference in specific resistance between the two kinds of particles, whereby highly purified coal B is obtained as entrained on the gas stream at the outlet 3 of the chamber means 2.

5 Claims, 1 Drawing Figure

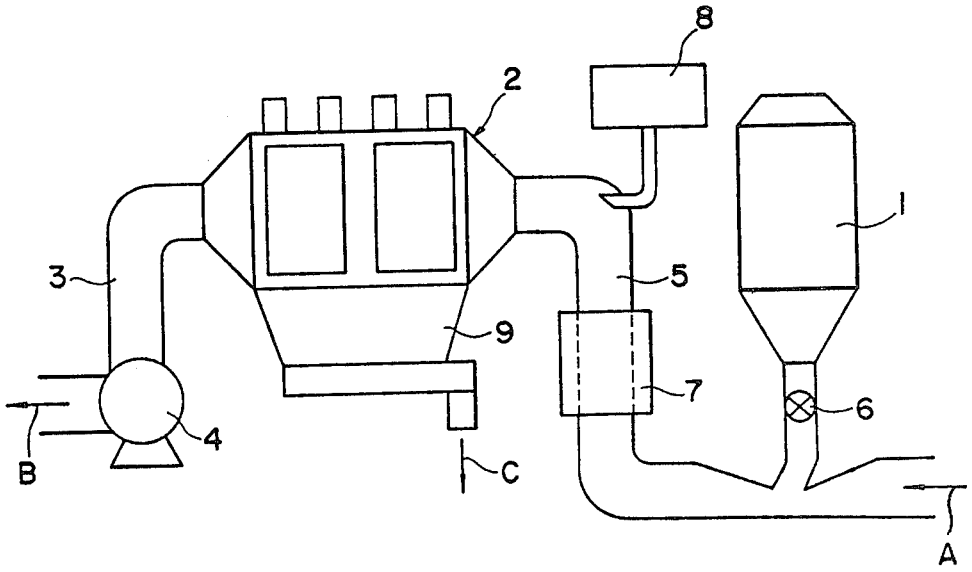
8
2
1
3
5
9
7
6
4
B
C
A

PROCESS FOR REMOVING ASH FROM COAL

TECHNICAL FIELD

The present invention relates to a process for removing ash from coal, and more particularly to a process for purifying pulverized coal by effectively eliminating coexistent ash therefrom.

BACKGROUND ART

While pulverized coal is chiefly composed of carbon particles, it also contains as impurites particulate ash such as particles of $SiO_2$, CaO, $Al_2O_3$, etc. When put into use as fuel, pulverized coal should advantageously contain no or at least reduced ash. A conventional method heretofore employed to purify pulverized coal comprises adding pulverized coal to water followed by stirring, and subsequently adding to the mixture oil as a separating agent again followed by agitating. Ash can be separated and removed from the coal by utilizing the lipophilic property of coal. With such a method, however, not only is the working efficiency low but also is it difficult to control separation accuracy.

DISCLOSURE OF THE INVENTION

It is an object of the present invention to provide a process for removing ash from coal which is excellent in working efficiency and which provides easy control of separation accuracy.

To fulfil this object, the present invention provides a process for removing ash from coal comprising the steps of transferring pulverized coal to be treated by entraining it on a stream of non-oxidizing gas, feeding the coal laden gas into dry-type electric precipitating chamber means after suitably adjusting the temperature and humidity of the gas during transport, and separating particulate ash from the coal particles by capturing the former in the precipitating chamber means by virtue of difference in specific resistance between the two kinds of particles, whereby highly purified coal is obtained as entrained on the gas stream at the outlet of the chamber means.

The non-oxidizing gas usable in this method comprises one or any combination of carbon dioxide gas, nitrogen gas and an inert gas.

Needless to say, the temperature and humidity of the coal laden non-oxidizing gas stream should preferably be so adjusted that the degree of separation of the particulate ash from the carbon particles is increased to the greatest extent. For example, the humidity is set to 10%, and the temperature to 100°-200° C. The features and effects of the present invention will become apparent from the following description of an embodiment given with reference to the accompanying drawing.

BRIEF DESCRIPTION OF THE DRAWINGS

The drawing is a schematic view showing a coal treating system for effectively carrying out the invention.

BEST MODE OF CARRYING OUT THE INVENTION

In the drawing illustrating a coal (pulverized coal) treating system, numeral 1 represents a hopper for storing pulverized coal to be treated; numeral 2 a drytype electric precipitator disposed downstream from the hopper 1; numeral 3 a discharge duct extending from the precipitator 2; numeral 4 a blower provided in the duct 3; numeral 5 a feed duct connecting the entrance of the precipitator 2 and the outlet of the hopper 1; numeral 6 a discharge means provided in the outlet of the hopper 1 for discharging constant amounts of pulverized coal; and numerals 7 and 8 a temperature adjusting unit and a humidity adjusting unit, respectively, disposed in or on the feed duct 5.

A non-oxidizing carrier gas comprising carbon dioxide gas, nitrogen gas, an inert gas or the like is supplied through one end of the feed duct 5 close to the hopper 1. The arrow A in the drawing indicates the flow of the carrier. Pulverized coal continually discharged, in constant amounts, from the hopper 1 by the discharge means 6 is entrained on the carrier gas and transferred toward the precipitating chambers of the electric precipitator 2 by the drawing action of the blower 4. Before entering the precipitator 2, the coal laden gas is heated to a predetermined temperature by the temperature adjusting unit 7 and humidified by the humidity adjusting unit 8 to a humidity of not less than 10% for example. The gas then enters the precipitating chambers.

The specific resistance $\rho c$ of carbon particles is generally represented by $\rho c < 10^4(\Omega\cdot cm)$ and thus is low while the specific resistance $\rho a$ of ash particles is medium as indicated by the expression $10^4(\Omega\cdot cm) < \rho a < 10^{11}(\Omega\cdot cm)$. Due to this difference in specific resistance, particulate ash is captured by unillustrated dust-collecting electrodes in the electric precipitator 2 so that highly purified coal as entrained on the carrier gas is discharged into the discharge duct 3 communicating the precipitator outlet. The arrow B represents the flow of the carrier gas entraining pulverized coal of high purity. Although particulate carbon is captured similarly by the dust-collecting electrodes once under certain conditions, it is forced back to scatter away due to the aforementioned resistivity difference. Thus particulate ash alone is reliably captured by the dust-collecting electrodes in the precipitator 2. The captured particulate ash thereafter goes down the electrodes to fall into the collector 9 of the precipitator 2. The arrow C indicates discharge of the ash.

The specific resistance of particulate ash is minimum at about 50°-60° C. and increases with temperature up to the maximum value at about 100°-200° C., followed by gradual decrease with further temperature rise. In view of this, the temperature adjusting unit 7 must be operated to control the temperature of the carrier gas so that particulate ash has a high resistivity to enhance the collecting efficiency of the ash in the precipitator 2. On the other hand, since the electric precipitator 2 can be operated at high voltage if the precipitating chambers thereof are at high humidity, the humidity adjusting unit 8 must be so operated as to enable such high voltage operation of the precipitator 2. Logically stated, a strong electric field produced by the high voltage operation of the precipitator 2 affords improved dust collecting efficiency, hence enhanced ash separating efficiency.

Needless to say, it is possible to improve the ash separation accuracy by suitably increasing the number of the precipitating chambers of the precipitator 2.

Since the method according to the invention described above comprises the steps of entraining pulveried coal on a stream of non-oxidizing gas for transfer, feeding the coal laden gas into dry-type electric precipitating chamber means after suitably adjusting the temperature and humidity of the gas during transport, separating ash particles from the coal particles by capturing the former in the chamber means by virtue of difference in specific resistance between the two kinds of particles, and obtaining, at the outlet of the chamber means, highly purified coal as entrained on the gas stream, it can provide improved working efficiency of ash separation as well as readier control over the separation accuracy. Further since the precipitating chamber means is filled with a non-oxidizing gas, there is no likelihood, in the chamber means, of explosion due to discharging sparks in spite of inflowing coal particles, thus assuring safe purification of pulverized coal.

We claim:

1. A process for physically removing particulate inorganic impurities from pulverized coal by subjecting the pulverized coal to electrostatic separation based on the difference in specific resistance between said particulate inorganic impurities and the coal particles, characterized in that (a) the pulverized coal is entrained on a stream of non-oxidizing gas for transport and passed through a dry-type electric precipitator to selectively capture the particulate inorganic impurities in said precipitator, (b) the coal laden gas is subjected to temperature and humidity adjustment in separate steps prior to the introduction of the gas into said precipitator, said temperature adjustment being effected to enhance said difference in specific resistance, said humidity adjustment being effected to enable a high voltage operation of said precipitator, and (c) highly purified coal is obtained at the outlet of said precipitator as entrained on the gas stream.

2. A process as defined in claim 1 wherein said non-oxidizing gas comprises one or any combination of carbon dioxide gas, nitrogen and an inert gas.

3. A process as defined in claim 1 or 2 wherein the humidity of the coal laden gas stream is adjusted to not less than about 10%.

4. A process as defined in claim 1 or 2 wherein the coal laden gas stream is heated to a temperature of about 100°to 200° C., for example, at which the inorganic impurities have a maximum specific resistance.

5. A process as defined in claim 3 wherein the coal laden gas stream is heated to a temperature of about 100° to 200° C., for example, at which the inorganic impurities have a maximum specific resistance.

* * * * *